US005460201A

United States Patent [19]

Borcea et al.

[11] Patent Number: 5,460,201

[45] Date of Patent: Oct. 24, 1995

[54] ELECTROMECHANICAL SERVOVALVE

[76] Inventors: Nicky Borcea, 95 Steep Hill Rd.; Alexandru D. Ionescu, 78 Catbrier Rd., both of Weston, Conn. 06883

[21] Appl. No.: 249,949

[22] Filed: May 27, 1994

Related U.S. Application Data

[63] Continuation of Ser. No. 57,898, May 7, 1993.

[51] Int. Cl.[6] ..... F15B 13/044

[52] U.S. Cl. ..... 137/625.65; 251/905

[58] Field of Search ..... 137/625.65; 251/905

[56] References Cited

U.S. PATENT DOCUMENTS

| | | | |
|---|---|---|---|
| 3,099,280 | 7/1963 | Holzbock | 137/625.65 X |
| 3,466,003 | 9/1969 | Boonshaft et al. . | |
| 3,807,441 | 4/1974 | Grosseau | 137/625.65 X |
| 3,840,045 | 10/1974 | Grosseau | 137/625.65 X |
| 4,040,445 | 8/1977 | McCormick . | |
| 4,544,129 | 10/1985 | Ichiryu et al. . | |
| 4,648,580 | 3/1987 | Kuwano et al. | 137/625.65 X |
| 5,012,722 | 5/1991 | McCormick . | |
| 5,076,537 | 12/1991 | Mears, Jr. . | |

FOREIGN PATENT DOCUMENTS

| | | | |
|---|---|---|---|
| 56-167906 | 12/1981 | Japan . | |
| 57-1807 | 1/1982 | Japan | 137/625.65 |
| 58-166183 | 10/1983 | Japan . | |
| 62-83572 | 9/1987 | Japan . | |
| 196517 | 6/1965 | Sweden . | |

*Primary Examiner*—Gerald A. Michalsky
*Attorney, Agent, or Firm*—Fattibene and Fattibene; Paul A. Fattibene; Arthur T. Fattibene

[57] ABSTRACT

This disclosure is directed to an electromechanical servovalve having a movable electrical coil or winding circumscribing a solid permanent magnet and disposed so that when the winding is energized by an electric current, it interacts with an intensified magnetic flux generated by the permanent magnet to shift a valve member of an associated valve between an operative and inoperative position. The arrangement is such that the valve member also functions as the sole bearing support for the movable coil whereby the servovalve is rendered lighter and faster in operation.

1 Claim, 3 Drawing Sheets

ELECTROMECHANICAL SERVOVALVE

RELATED APPLICATION

This application is a continuation of application Ser. No. 08/057,898 filed May 7, 1993 for Electromechanical Servovalve.

FIELD OF INVENTION

This invention is directed to an electromechanical servovalve for controlling the operation of an associated fluid control valve.

PRIOR ART

Heretofore, electromechanical servovalves of the type disclosed in U.S. Pat, No. 4,040,445 and 5,076,537 incorporated a movable coil and associated header relative to a donut shaped permanent magnetic source to control the operation of a valve member wherein the movable coil and associated header required a bearing support on either side thereof, with the bearing at one end extending through a donut shaped magnet source. It has been noted that such bearing support and donut shaped magnet, as were commonly used in such servovalves in the past, rendered the unit bulky and heavy which retarded the speed of the valve. U. S. Pat. No. 3,099,280 illustrates the use of movable coil or winding operating a hydraulic servovalve. Other servovalves with movable coils have been patented, e.g. Swedish patent 196,517; Japanese publications 56-167906; 58-166183 and 62-83572; U.S. Pat. No. 3,466,003; 4,544,129 and 5,012,722. However, each of these prior art patents also disclose the use of a permanent magnet having a donut shape associated with a movable coil. As faster acting valves are desirable, a need for a faster acting valve is paramount.

OBJECTS

An object of this invention is to provide a voice coil electromechanical servovalve with a novel bearing arrangement for supporting the coil or winding to create a lighter and faster acting electromechanical servovalve that is free of any lateral forces acting on the movable coil or winding and having an arrangement whereby the servovalve can be readily adjusted to insure the maintenance of the servovalve in its neutral position when the electromechanical servovalve is de-energized for any reason.

SUMMARY OF THE INVENTION

The foregoing objects and other features and advantages are attained by an improved electromechanical servovalve having a coil housing connected to an axially aligned valve body having a reciprocating slidably mounted spool valve member to control the flow of operating fluid through the valve. The actuation of the spool valve member is effected by the interaction of an electrical coil or winding movably mounted relative to a magnetic flux generated by a solid, cylindrical shaped permanent magnet. According to this invention, the stem of the spool valve member is rigidly connected to the movable coil or winding so that when the coil or winding is energized by an electric current, the coil or winding is displaced to shift the spool valve relative to the inlet and outlets of the valve assembly to control the flow of operating fluid therethrough accordingly. The arrangement is such that the valve member functions as the sole bearing support for the movable coil or winding.

In accordance with this invention, the valve member is under a spring bias to assure that the valve member is maintained in a neutral inoperative position whenever the coil or winding is de-energized. In one form of the invention, counterbalancing coil springs are disposed at each end of the valve member to impart a counteracting bias directly on the ends of the valve member. An adjusting screw is operatively associated with one of the coil springs to adjust the spring bias action on the valve member as may be necessary to maintain the neutral position in the inoperative position of the valve. In another form of the invention, one of the coil springs is interposed between the magnet means and the movable coil or winding and in axial alignment with the valve member.

IN THE DRAWINGS

DETAILED DESCRIPTION

Figure 1:
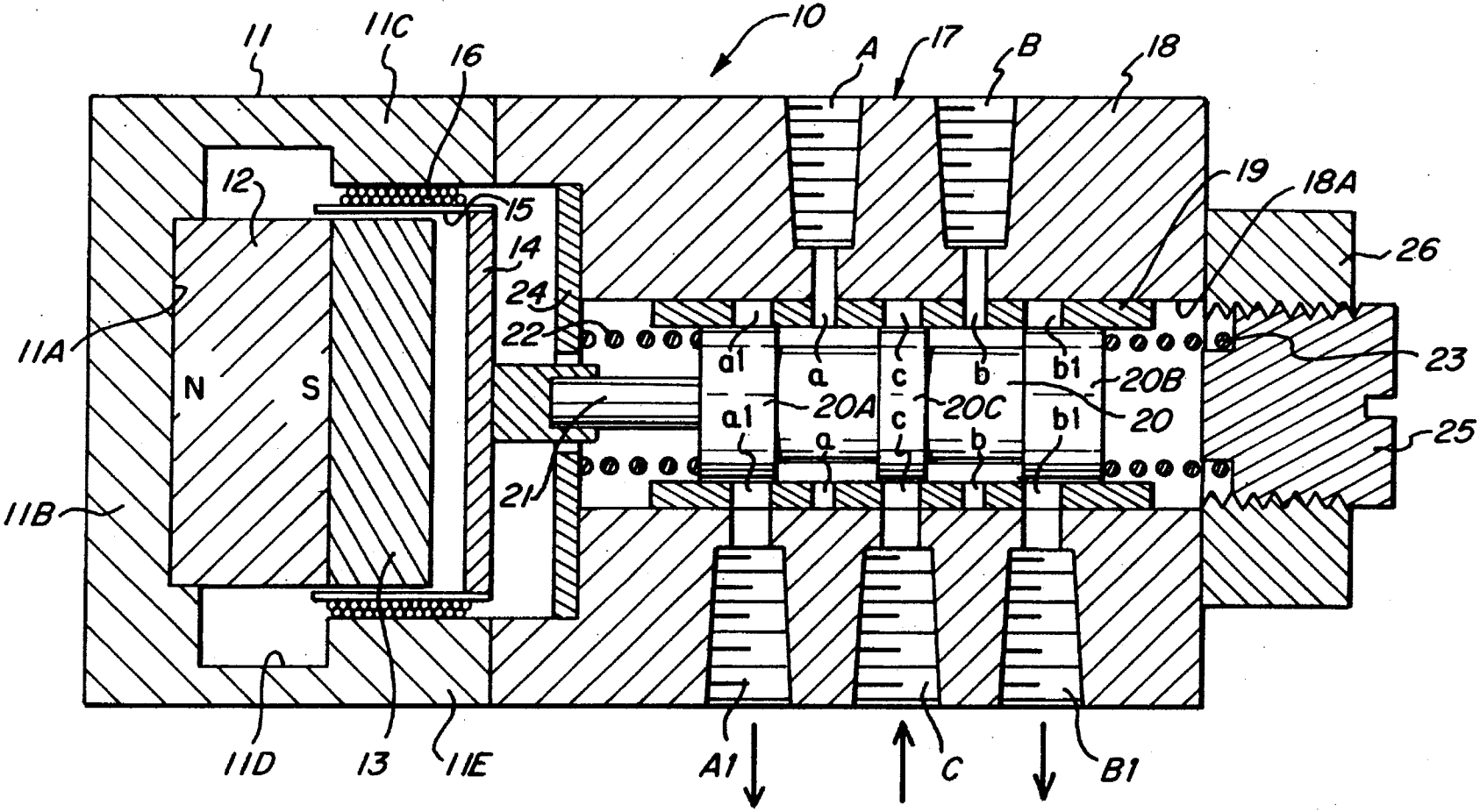
FIG. 1 illustrates a cross-sectional view of an electromechanical servovalve embodying the invention with the valving member illustrated in a neutral inoperative position.
Figure 2:
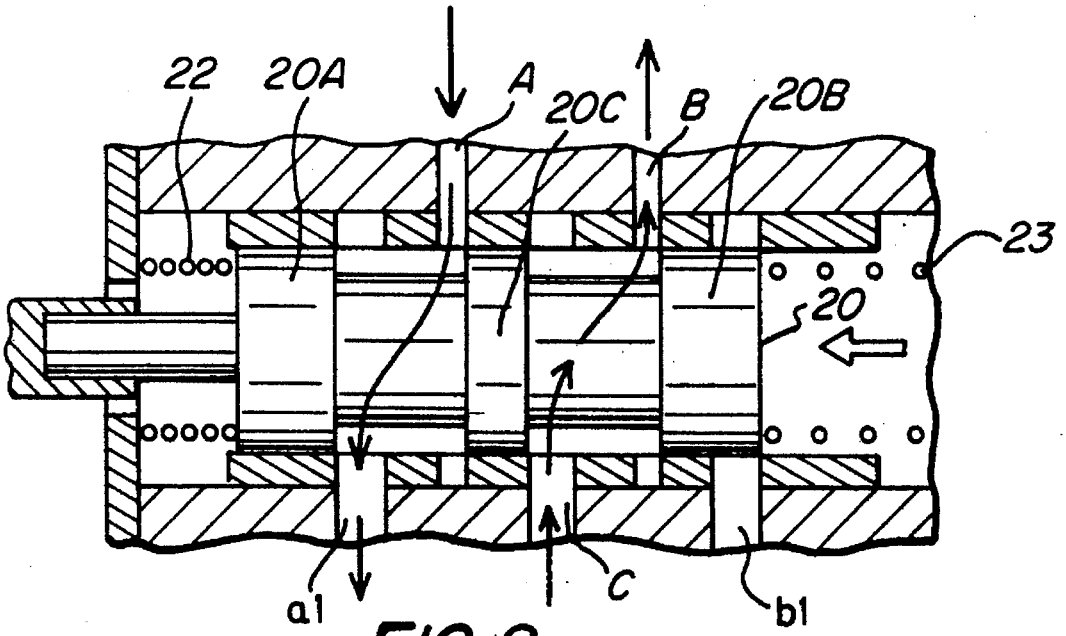
FIG. 2 illustrates a fragmentary sectional view of FIG. 1 illustrating the valving member in a first operative position.
Figure 3:
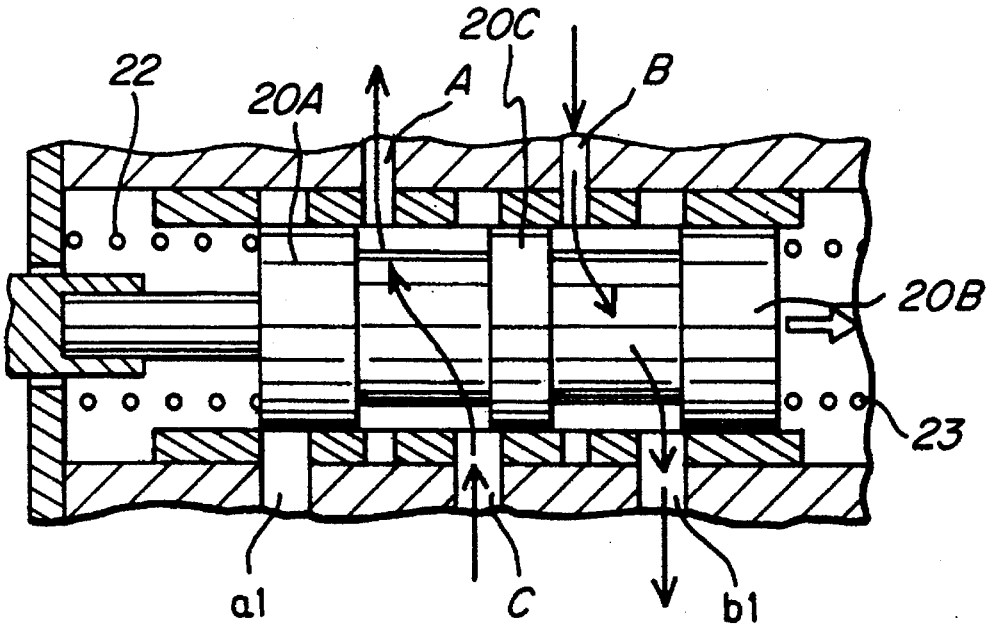
FIG. 3 illustrates a fragmentary section view of FIG. 1 illustrating the valving member in a second operative position.

Referring to FIGS. 1 to 3, there is shown an electromechanical servovalve 10 for controlling the operation of a particular machine or apparatus not shown. It will be understood that servovalve 10 is suitably connected to the machine or apparatus to be controlled thereby. As shown in FIG. 1, the electromechanical servovalve 10 comprises a coil housing 11 in which there is disposed a permanent magnet 12 and an associated pole piece 13 to generate a magnetic flux.

In the illustrated embodiment, the coil housing is provided with a back wall 11B and a connected circumscribing end wall 11C. Formed in the back wall 11B is a recess or seat 11A for receiving the permanent magnet 12. As illustrated, the permanent magnet 12 is formed as a solid cylinder having a magnetic axis disposed parallel to the motion of the windings 16, with the surface defining the north pole disposed in seat 11A. Adjacent the seat 11A, the coil housing 11 is provided with an enlarged counterbore 11D. The arrangement of the coil housing 11 is such that the circumscribing end of the end wall 11C is provided with a thickened portion 11E, which is slightly spaced from the pole piece 13 to define therebetween the air space in which the windings 16 are located. The pole piece 13 redirects the magnetic flux across the air space substantially perpendicular to the magnetic axis of the permanent magnet and functions to intensify and direct the magnetic flux over the relatively small lateral edge area of the pole piece in the vicinity of the air space and the windings therein. Thus, the magnetic flux generated by the magnet 12 is intensified in the vicinity of the air space and the windings 16 located therein.

Preferably, the permanent magnet 12 is secured to a recess or seat 11A, formed in the end of the coil housing 11. The pole piece 13 is connected to the other pole of the permanent magnet 12, e.g. the south pole. Associated with the permanent magnet 12 and connected pole piece 13 is a movable header 14 and a connected cylindrical core 15 about which an electric coil or winding 16 is wound and which is energized by an electric current. The arrangement is such that whenever the coil or winding 16 is energized by an electric current, it interacts with the magnetic flux generated by the permanent magnet 12 to create an electromagnetic force to shift the header relative to the magnet 12.

Connected to the coil housing 11 is a servovalve assembly 17 which comprises a valve body 18 having fluid outlets A and B, and a fluid inlet C. It will be understood that the fluid inlet C is connected to a suitable source of operating fluid, e.g. a source for compressed air or hydraulic fluid, and the respective outlets A and B are connected to suitable operating mechanism to be controlled by the valve assembly, e.g., an operating piston and cylinder (not shown). The valve body 18 may also be provided with exhaust outlets A1 and B1 for the cylinders associated with outlets A and B respectively.

The valve body 18 is provided with a through bore 18A disposed in axial alignment with the movable header 14. Disposed within the bore 18A is a valve sleeve 19 which is provided with a plurality of circumferentially spaced ports a, b, c, a1 and b1 arranged to be disposed in communication with the outlets A and B, inlet C and exhaust outlets A1 and B1 respectively. Slidably disposed within the valve sleeve 19 is a spool valve member 20 having spaced valve heads 20A, 20B and 20C for valving the inlet C and exhaust outlets a1 and b1 as the valve member 20 is shifted accordingly; as will be hereinafter described.

One end of the valve member 20 has connected thereto a valve stem 21 which rigidly connects the valve spool member 20 to the movable header 14.

As best seen in FIG. 1, the valve member 20 is spring biased in its neutral or inoperative position. In the embodiment of FIG. 1, this is attained by a pair of coil springs 22 and 23 exerting a spring bias on the opposed ends of the valve spool member 20. As shown, the coil spring 22 circumscribes the valve stem 21 and is disposed between a stop 24 and the end of valve head 20A. Spring 23, exerting a counterbalancing bias on the valve member 20, is disposed between the other end of the valve member or valve head 20B and an adjusting screw 25 which is threaded to an adaptor 26 connected to the end of the valve body in alignment with the axis of the valve body 17. By turning the adjusting screw in one direction or the other, it will be noted that the bias exerted by the springs can be adjusted so as to insure the maintenance of the valve member in its neutral position as shown in FIG. 1 when the coil or windings 16 are de-energized. In the embodiment described, it will be apparent that the bearing for the movable header 14 comprises the valve heads 20 A, B and C of valve member 20. Thus, the valve spool member 20 comprises the sole bearing for the header 14 and associated movable coil. In accordance with this invention, the spool valve member 20 functions both as a valving member and a bearing for the movable header, which construction makes the overall assembly lighter and faster in operation.

In operation, when the coil or winding 16 is energized to shift the valve member 20 to the left as seen in FIG. 2, the respective spool heads 20 A, B and C are shifted to the left whereby the inlet C is placed in communication with outlet B to actuate the mechanism or cylinder connected to outlet B while outlet A is disposed in communication with exhaust port al for deactivating the cylinder or mechanism connected to outlet A. When the spool valve member 20 is shifted to the right of neutral as shown in FIG. 3, the operation is reversed, i.e. the inlet C is placed in communication with outlet A, whereas the outlet B is connected to exhaust b1 to deactivate the mechanism or cylinder connected to outlet B. In the event that the coil or winding 16 is de-energized for any reason, the springs 22, 23 will bias the spool valve member toward its neutral or inoperative position wherein the spool head 20C seals off the inlet C, as shown in FIG. 1.

Figure 4:
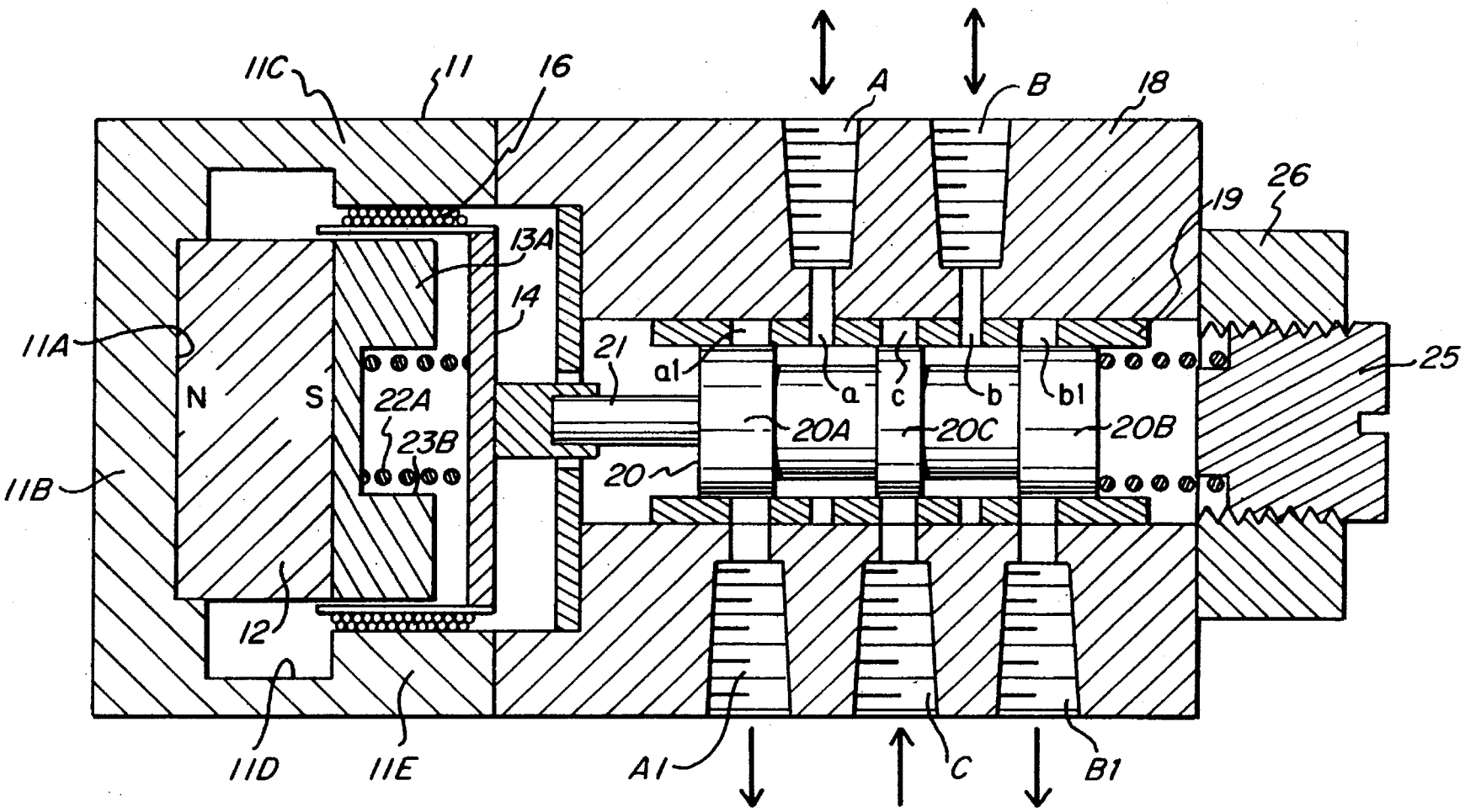
FIG. 4 is a longitudinal sectional view of a slightly modified embodiment of the invention.

The embodiment of FIG. 4 is identical with that described with respect to FIG. 1 with the exception that one of the springs 22A has been relocated. As shown in FIG. 4, spring 22A is disposed between the pole piece 13A and the movable header 14 whereby the spring 22A acts directly on the header 14 and indirectly on the valve member 20. To position the spring 22A, the pole piece 13A may be provided with a seat 13B for receiving the spring 22A. In all other respects, the operation and construction of the electromechanical valve of FIG. 4 is identical to that described with respect to FIGS. 1 to 3.

The solid, cylindrical construction of the permanent magnet 12 together with the associated pole piece 13, having a width which is less than that of the permanent magnet 12 is located centrally of the core cylinder 15 so that the windings 16 are disposed in the space between coil housing 11 and the pole piece 13. The permanent magnet and coil housing construction functions to intensify the magnet field or flux. As a result, the amount of current required to actuate the coil or winding is reduced to result in a reduction of heat generated in the core.

While the invention has been described with respect to the illustrated embodiments, it will be understood and appreciated that variations and modifications may be made without departing from the spirit or scope of the invention.

What is claimed is:

1. An electromechanical servovalve comprising:

a valve body and a connected coil housing, said coil housing having a back wall and a connected circumscribing end wall, said end wall terminating in a circumscribing thickened portion having a longitudinal thickness greater than said back wall and connected end wall, said back wall of said coil housing having a recessed seat formed therein, a solid, permanent magnet positioned in said seat whereby a pole face of said magnet is in contact with said back wall, said seat closely conforming to the periphery of said permanent magnet, an enlarged counterbore formed in said coil housing and circumscribing said recessed seat, said counterbore reducing the radial thickness of said circumscribing end wall of said coil housing in the vicinity of said counterbore and intermediate of said coil housing, a pole piece connected to the other pole of said magnet, said magnet and connected pole piece having their outer periphery spaced from said circumscribing end wall and said thickened portion of said coil housing to define an air space therebetween, a movable header mounted for movement relative to said magnet, a cylindrical core connected to said header, said core extending into said air space, an electrical winding disposed about said core, said valve body having a fluid inlet and a fluid outlet, a spool valve disposed within said valve body for valving said fluid inlet and outlet, a stop interposed between said coil housing and said valve body, a valve stem rigidly connecting said spool valve member to said header whereby said spool valve member defines the sole bearing support of said header and connected cylindrical core, said spool valve member having a plurality of longitudinally spaced valve heads, spring means for biasing said spool valve member toward a neutral position in the de-energized state of said winding, said spring means including a first coil spring axially disposed between said header and said spool valve member, said first coil spring being disposed between said stop and adjacent valve head for exerting a direct bias on the adjacent valve head, and a second coil spring disposed on the opposite side of said spool valve member in axial alignment therewith, an adjusting screw, said second coil spring interposed between said adjusting screw and the opposite adjacent valve head, said adjusting screw for adjusting the bias exerted by said second coil spring on said spool valve, and said thickened portion of said end wall adjacent said winding intensifies the magnetic flux in the vicinity of the winding when said winding is energized.

* * * * *